United States Patent [19]

Buchman

[11] 4,217,662

[45] Aug. 19, 1980

[54] COMFORTER AND ROBE COMBINATION

[75] Inventor: Alex Buchman, New York, N.Y.

[73] Assignee: Barclay Home Products, Inc., New York, N.Y.

[21] Appl. No.: 926,547

[22] Filed: Jul. 20, 1978

Related U.S. Application Data

[63] Continuation-in-part of Ser. No. 897,187, Apr. 17, 1978.

[51] Int. Cl.[2] ..... A41B 9/00; A41D 9/00

[52] U.S. Cl. ..... 2/69.5

[58] Field of Search ..... 2/69.5, 114, 69, 74

[56] References Cited

U.S. PATENT DOCUMENTS

| | | | |
|---|---|---|---|
| 536,383 | 3/1895 | Huyck | 2/69.5 |
| 906,551 | 12/1908 | Newman | 2/69.5 |
| 2,656,540 | 10/1953 | Stephenson | 2/69.5 |
| 4,142,264 | 3/1979 | Whiting | 2/69.5 X |

*Primary Examiner*—Werner H. Schroeder
*Assistant Examiner*—Doris L. Troutman
*Attorney, Agent, or Firm*—Friedman, Goodman & Teitelbaum

[57] ABSTRACT

A comforter having a blanket-like body member is provided with closure members for enclosing a lower portion thereof so that one lower side edge is secured to a corresponding opposite lower side edge and the bottom edge is secured together to define a sack-like robe configuration. A snap fastener is disposed at each upper corner for attachment to associated snap fasteners disposed adjacent to but slightly above the closure member on the side edges so that the upper half side edges can be held in a folded condition to provide a pair of sleeve portions on the body member, each sleeve portion having a predetermined maximum sleeve opening. At least two additional snap fasteners are disposed at intermediate positions on each upper half side edge for securement together to obtain a preselected sleeve opening smaller than the maximum sleeve opening. Preferably, several snap fasteners are disposed along the top edge of the body member for engagement therebetween to enclose the body member around the wearer's chest.

2 Claims, 7 Drawing Figures

COMFORTER AND ROBE COMBINATION

RELATIONSHIP TO OTHER APPLICATION

This application is a Continuation-in-Part application of Ser. No. 897,187, filed on Apr. 17, 1978 for "COMFORTER-ROBE" by the same inventor. All the information contained in the aforementioned application is herein incorporated by reference.

BACKGROUND OF THE INVENTION

The present invention relates to a blanket-like comforter which may be used as a body wrap or robe for enclosing men, women, and children, and more particularly to a comforter and robe combination which is provided with closure or fastening means disposed along the edges of the comforter so that the comforter can be converted to a body covering having sleeve portions thereon, while the sleeve openings are adjustable to a preselected size.

Comforter-robe garments are well known in the art, as shown in U.S. Pat. No. 536,383, No. 1,346,320 and No. 2,701,885 to name just a few of such patents. These garments provide warmth and comfort, while allowing the user to sit in an upright position and perform manual activity, read and the like. However, though these patents disclose sleeve portions, these prior art sleeve portions have large openings where no provision is provided for reducing the sleeve openings to a smaller preselected size. Accordingly, these prior art large openings permit cold air to penetrate into the garment and also cause the garment to be quite bulky and unmanageable at the sleeve openings.

SUMMARY OF THE INVENTION

Accordingly, it is an object of the present invention to provide a comforter and robe combination which overcomes the disadvantages of the prior art.

Another object of the present invention is to provide a comforter and robe combination which allows the wearer to have greater mobility with his hands and arms, and if desired, also his feet.

A further object of the present invention is to provide a comforter and robe combination which includes adjustment means for regulating the size of the sleeve openings in addition to the securement of the bottom edge thereof.

A still further object of the present invention is to provide a comforter and robe combination which is simple in construction and can be easily and economically manufactured.

And yet another object of the present invention is to provide a comforter and robe combination in which the wearer can easily enclose his body therein while permitting quick removal thereof, where the comforter and robe combination allows the wearer's hands and even his feet to be exposed for free movement thereof.

The structure of the present invention includes a comforter and robe combination having a blanket-like body member provided with closure means for enclosing a lower portion thereof with one lower side edge being secured to a corresponding opposite lower side edge and the bottom edge being secured together. Snap fastener means are disposed at each upper corner for attachment to associated snap fastener means which are disposed adjacent to but slightly above the closure means on the side edges, whereby the upper half side edges are held in a folded condition to provide a pair of sleeve portions on the body member, each sleeve portion having a predetermined maximum sleeve opening. Additional snap fastener means are disposed at intermediate positions on each upper half side edge for engagement with each other to obtain a predetermined sleeve opening smaller than the maximum sleeve opening. Other snap fastener means are disposed along the top edge of the body member for engagement therebetween to enclose the body member around the wearer's chest. The bottom edge of the body member is secured together by snap means to provide a sack-like configuration.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

DETAILED DESCRIPTION OF THE PREFERRED EMBODIMENT

Figure 1:
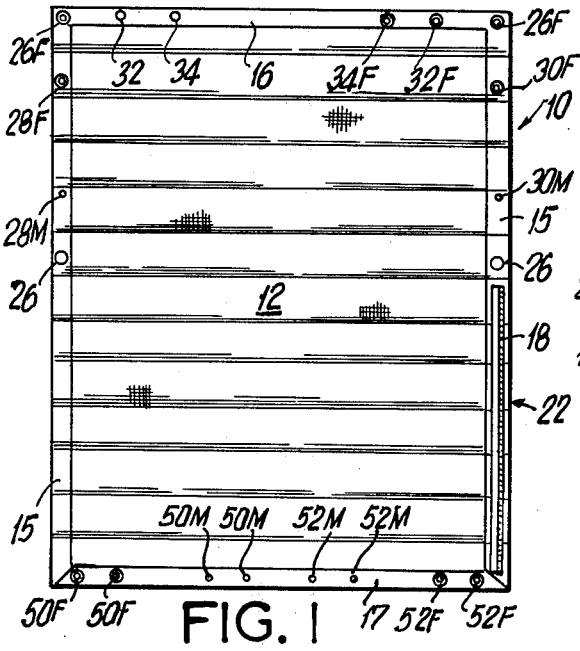
FIG. 1 is an elevational view showing the inside surface of the comforter according to the present invention.
Figure 2:
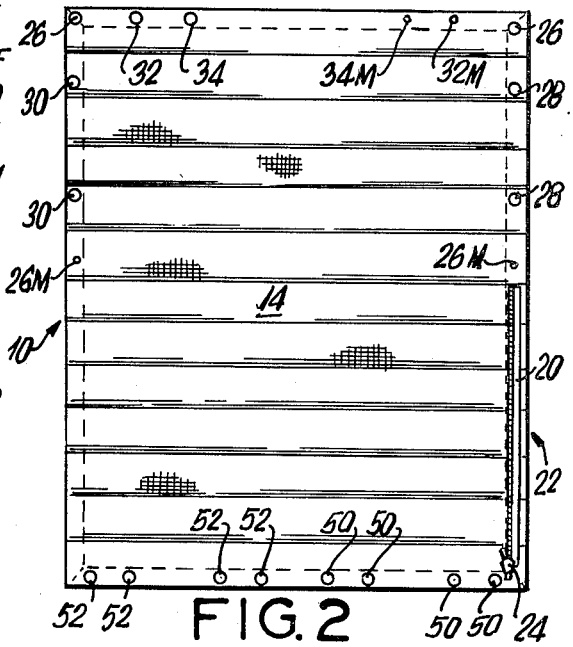
FIG. 2 is an elevational view showing the outside surface of the comforter.

Referring to the drawings, FIGS. 1 and 2 illustrate the comforter of the comforter and robe combination 10, according to the present invention, in a planar arrangement to show the inner surface 12 and the outer surface 14 thereof. The comforter has a blanket construction, which is preferably quilted and filled with conventional insulation to define a comforter type construction. Preferably, opposing hems 15 are provided along the inside side edges, a hem 16 is provided on the inside top edge and a hem 17 is provided on the inside bottom edge for a proper finish to enhance the appearance thereof. Zipper stringers 18, 20 are secured by conventional means, such as stitching, to opposite side edge portions on the inside side edge hem 15 on the surface 12 and on the outside surface 14, respectively, to provide a zipper fastener 22 having a conventional zipper clasp 24. The zipper fastener 22 is disposed adjacent to the bottom edge of the comforter and extends upwardly to a point slightly above the lower half of the body member of the comforter so that the side edges can be secured together and also released with the side edges completely separated from each other, as will be explained more fully hereinafter below. As indicated in the drawings, the zipper fastener extends to approximately 53% of the length of the comforter when measured from its bottom edge.

The upper half of the comforter is provided with sets of snap fasteners disposed along the top edge and side edges thereof. Accordingly, a female snap portion 26F is disposed in each upper corner and extends outwardly from the inside surface 12 for snap engagement with an associated one of the male snap portions 26M which extend outwardly from the outside surface 14 to define a set of snap fasteners 26. The male snap portions 26M are disposed on opposite side edges adjacent to but above the zipper stringers 18, 20 respectively.

Other sets of snap fasteners 28, 30 are disposed on opposite sides along the side edges between the snap portions 26F and 26M. The male and female snap portions 28M, 30M and 28F, 30F extend outwardly from the inside surface 12, with the female snap portions 28F, 30F being preferably disposed above the male snap portions 28M, 30M.

Further sets of snap fasteners 32, 34 are disposed along the top edge, where the female snap portions 32F, 34F extend outwardly from the inside surface 12 and the male snap portions 32M, 34M extend outwardly from the outside surface 14. Preferably, the female snap portions 32F, 34F are disposed on one side and the male snap portions 32M, 34M are disposed on the opposite side. As indicated in the drawings, the innermost male and female snap fasteners 34M and 34F are spaced apart approximately 47% of the width of the comforter.

Figure 3:
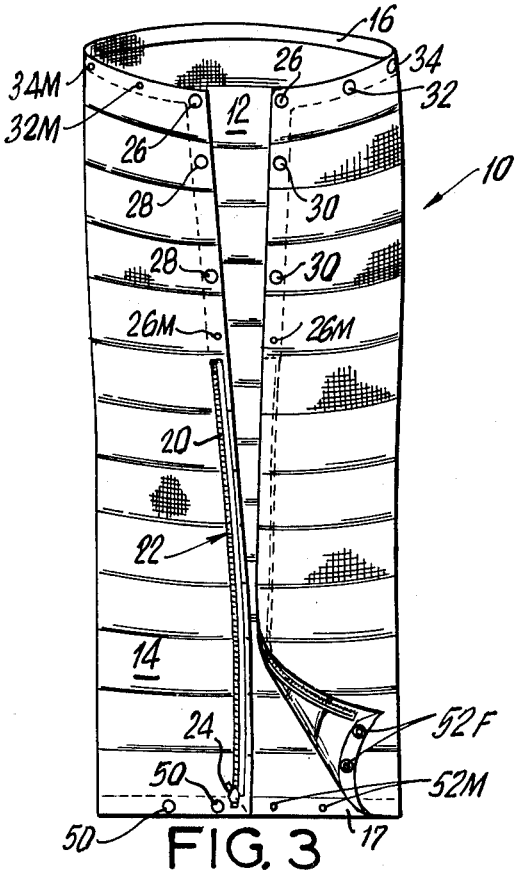
FIG. 3 is an enlarged front perspective view of the comforter in a sack-like configuration prior to being worn.

As shown in FIGS. 1–3, still further sets of snap fasteners 50, 52 are disposed along the bottom edge, where the female snap portions 50F, 52F and the male portions 50M, 52M extend outwardly from the bottom hem 17 on the inside surface 12. Preferably, the female snap portions 50F are disposed at one end and the female snap portions 52F are disposed at the other end of the inside surface 12 with the cooperating male snap portions 50M, 52M being disposed on opposite sides of the center line thereof closest to their female portions on the intermediate part of the bottom hem 17. Thus, the sets of snap fasteners 50, 52 secure the bottom edge of the comforter and robe combination 10 together in a folded lapped arrangement as indicated in FIG. 3.

The comforter and robe combination 10 is formed into a sack-like configuration with the bottom edge folded on itself in a lapped arrangement secured together by the above mentioned closure means 50, 52. In this arrangement, the comforter and robe combination 10 is in condition to receive the wearer thereof. Preferably, the wearer steps into the comforter and robe combination 10 having its bottom edge closed, and joins the clasp 24 on the stringer 20 to the stringer 18, and then pulls the clasp 24 of the zipper fastener 22 to a closed position, in a conventional manner. The lower portion of the wearer's body is now covered by the closed lower half of the comforter and robe combination 10, whereby the wearer may accomplish this procedure in a sitting position due to the upper half of the comforter and robe combination 10 still being opened.

Figure 4:
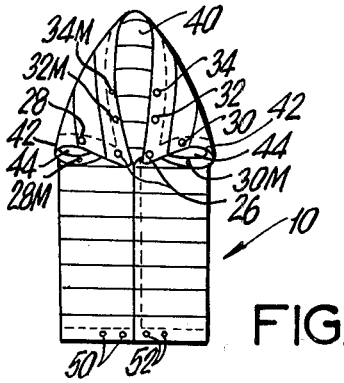
FIG. 4 is a front perspective view of the robe showing the formation of the sleeve portions thereof.

With the wearer inside the comforter and robe combination 10, the top corners are pulled over the wearer's shoulders and down the front of his body. The female snap portions 26F are now snapped together with the associated male snap portions 26M to obtain the configuration shown in FIG. 4. This configuration now provides a front opening 40 and a pair of sleeve portions 42, each having a predetermined maximum sleeve opening 44.

Figure 6:
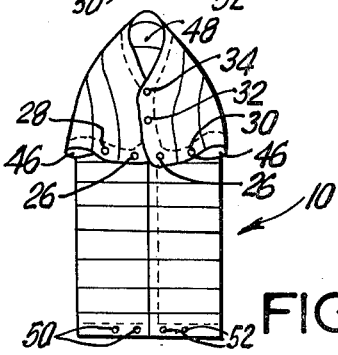
FIG. 6 is a front perspective view similar to FIGS. 4 and 5, showing the chest closure thereof.

The wearer now engages the female snap portions 28F, 30F with the male snap portions 28M, 30M to obtain preselected sleeve openings 46 which are smaller than the above mentioned maximum sleeve openings 44. If desired, the wearer can engage the female snap portions 32F, 34F with the male snap portions 32M, 34M, respectively, to enclose the chest of the wearer as shown in FIG. 6. Thus, an opening 48 smaller than the above mentioned opening 40 is provided so that the wearer's head can extend out of the comforter and robe combination 10. Additionally, the sleeve openings 46 permit the wearer to extend his hands or arms out of the comforter and robe combination 10.

Figure 5:
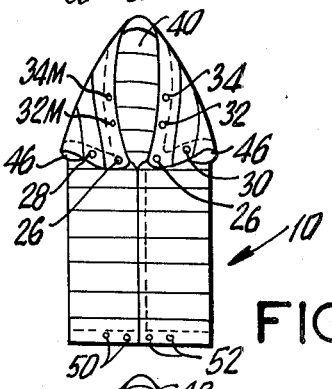
FIG. 5 is a front perspective view similar to FIG. 4 showing the adjustment of the sleeve portions.
Figure 7:
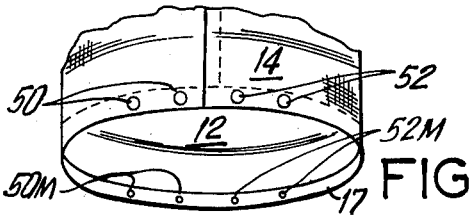
FIG. 7 is a fragmentary perspective view showing the bottom closure means for the comforter and robe combination.

FIG. 7 discloses the zipper fastener 22 in a closed position, however, the snap fasteners 50, 52 are not snapped together. Thus, the wearer can leave the bottom edge open to expose his feet for free movement thereof whereby the wearer can walk while still wearing the comforter and robe combination 10. Alternatively, the wearer can still close the bottom edge by snapping the snap fasteners together, this being performed even after the zipper fastener 22 is closed in order to enclose his feet therein for the arrangement shown in FIGS. 4–6.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A comforter and robe combination comprising:

a blanket-like body member having top, bottom and opposite side edges;

first closure means disposed on a lower portion of said body member to releasably secure a lower half portion of one side edge to a corresponding lower half portion of the other side edge;

second closure means disposed on said bottom edge to releasably secure said bottom edge to itself;

first fastener means at each upper corner for attachment to associated second fastener means, said second fastener means being respectively disposed on upper half portions of said opposite side edges adjacent to said closure means;

said first and second fastener means positioning each of said upper half portions in a folded condition to define a pair of sleeve portions on said body member, each sleeve portion having a predetermined maximum sleeve opening;

adjustment means disposed on each of said upper half portions of said side edges between said first and second fastener means for securing intermediate portions of each upper half portion together to obtain a preselected sleeve opening smaller than said maximum sleeve opening;

said adjustment means being snap fasteners;

said first and second fastener means being snap fasteners;

said snap fasteners of said adjustment means including male and female snap portions extending outwardly from an inside surface of said body member, said snap fasteners of said first fastener means including female snap portions extending outwardly from said inside surface of said body member, and said snap fasteners of said second fastener means including male snap portions extending outwardly from an outside surface of said body member;

said first closure means on said side edges including a zipper fastener extending to said bottom edge; and said second closure means on said bottom edge including snap fasteners.

2. A comforter of conventional rectangular shape having on its under side along one of its longer edges, a row of fastener elements and having on its upper side, along the opposite longer edge, a like row of associated fastening elements, said rows of fastening elements extending about 53% of the length of the comforter from its bottom edge, said comforter having along approximately the outer half portions of its bottom edge on its under side, a number of female fastening elements, and having along approximately the inner half portions of its bottom edge on its under side a like number of male fastening elements, whereby the comforter may be disposed with its under side up and the longer edges folded in toward the center and secured together by means of said two first mentioned rows of fastening elements, and the lapped bottom edges may be secured together by means of said two last mentioned sets of fastening elements to form a bag-like structure with the upper side out, said comforter further including at least two female fastening elements disposed on the under side along one side of the top edge of the comforter and a like number of male fastening elements disposed on the upper side at the other side of the top edge of the comforter, the innermost ones of said last mentioned male and female fastening elements being spaced apart about 47% of the width of the comforter, whereby the last named sets of fastening elements may be secured together with the upper corners of said comforter folded downwardly to cover the shoulders while leaving the head and hands of a user exposed, first fastener means being disposed at each upper corner for attachment to associated second fastener means, said second fastener means being respectively disposed on upper half portions of said opposite longer edges adjacent to said first mentioned rows of fastening elements, said first and second fastener means positioning each of said upper half portions in a folded condition to define a pair of sleeve portions on said bag-like structure, each sleeve portion having a predetermined maximum sleeve opening, adjustment means being disposed on each of said upper half portions of said longer edges between said first and second fastener means for securing intermediate portions of each upper half portion together to obtain a preselected sleeve opening smaller than said maximum sleeve opening, said adjustment means and said first and second fastener means being snap fasteners, said snap fasteners of said adjustment means including male and female snap portions extending outwardly from the under side, said snap fasteners of said first fastener means including female snap portions extending outwardly from the under side, and said snap fasteners of said second fastener means including male snap portions extending outwardly from the upper side, and said first mentioned rows of fastening elements being parts of a zipper fastener, said zipper fastener extending to said bottom edge.

* * * * *